US010529223B2

(12) United States Patent
Kalagani et al.

(10) Patent No.: US 10,529,223 B2
(45) Date of Patent: Jan. 7, 2020

(54) CALIBRATION OF HAZARD DETECTION SENSITIVITY BASED ON OCCUPANCY IN A CONTROL ZONE

(71) Applicant: Carrier Corporation, Palm Beach Garden, FL (US)

(72) Inventors: Ramana Babu Kalagani, Andhra Pradesh (IN); Eranna Kybarshi, Andhra Pradesh (IN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/142,880

(22) Filed: Sep. 26, 2018

(65) Prior Publication Data

US 2019/0355241 A1 Nov. 21, 2019

(30) Foreign Application Priority Data

May 17, 2018 (IN) ..... 201811018414

(51) Int. Cl.

| | |
|---|---|
| ***G08B 17/10*** | (2006.01) |
| ***G08B 29/26*** | (2006.01) |
| *G08B 21/12* | (2006.01) |
| *G08B 17/00* | (2006.01) |

(52) U.S. Cl.

CPC ..... *G08B 29/26* (2013.01); *G08B 17/00* (2013.01); *G08B 21/12* (2013.01)

(58) Field of Classification Search

CPC ..... F25B 23/006; F25B 41/003; F28D 15/00; F28D 2021/0029; F28D 21/00; F28F 13/02; F28F 3/12; F28F 9/26; F28F 7/02; F28F 9/0258; H05K 7/20327; H05K 7/20272; H05K 7/20772; H05K 7/20254; H05K 7/20263; H05K 7/20409; H05K 7/208; H05K 7/20836; H05K 1/0204; H05K 7/1427; H05K 7/1485; H05K 7/20309; H05K 7/2039; H05K 7/20809; H01L 2924/0002; H01L 2924/00; H01L 23/3672; H01L 23/46; H01L 23/4735

USPC ..... 340/628, 630, 565, 567, 501, 517, 521, 340/522, 632, 566, 686.1, 540, 603

See application file for complete search history.

(56) References Cited

U.S. PATENT DOCUMENTS

| | | | |
|---|---|---|---|
| 5,670,948 A | 9/1997 | Mochizuki et al. | |
| 7,221,260 B2 | 5/2007 | Berezowski et al. | |
| 7,224,284 B2 * | 5/2007 | Mi ..... | G08B 17/107 340/514 |

(Continued)

FOREIGN PATENT DOCUMENTS

WO 2017011504 A1 1/2017

OTHER PUBLICATIONS

Calectro; "Smole Detection for Ventilation"; 2018; Retrieved from the internee; URL:http://www.calectro.com/applications/smoke-detection-for-ventilation/, 5 pages.

*Primary Examiner* — Daniel Previl
(74) *Attorney, Agent, or Firm* — Cantor Colburn LLP

(57) ABSTRACT

Disclosed is an alarm device for detecting a hazard in a control zone, the alarm device having: a hazard sensor that comprises a configurable sensitivity level and a device controller that controls the sensitivity level of the hazard sensor, wherein the alarm device: receives over an electronic network a target sensitivity, and calibrates the hazard sensor to achieve the target sensitivity level.

10 Claims, 3 Drawing Sheets

(56) References Cited

U.S. PATENT DOCUMENTS

| | | | | |
|---|---|---|---|---|
| 7,336,168 | B2 * | 2/2008 | Kates | G08B 21/0236 340/506 |
| 7,541,924 | B2 | 6/2009 | Elwell | |
| 7,602,304 | B2 | 10/2009 | Tice | |
| 8,766,807 | B2 | 7/2014 | Gonzales | |
| 9,395,501 | B2 | 7/2016 | Yasuo | |
| 9,396,637 | B2 | 7/2016 | Chandler et al. | |
| 9,472,079 | B2 * | 10/2016 | Meier | B64D 45/00 |
| 2005/0177640 | A1 * | 8/2005 | Rubinstein | H04L 12/6418 709/229 |
| 2014/0340216 | A1 * | 11/2014 | Puskarich | G08B 17/11 340/539.11 |
| 2015/0061859 | A1 | 3/2015 | Matsuoka et al. | |
| 2016/0105598 | A1 * | 4/2016 | Zeira | H04N 5/23203 348/143 |
| 2017/0105268 | A1 * | 4/2017 | Balasubramainian | H05B 37/02 |
| 2017/0289650 | A1 | 10/2017 | Schattmaier et al. | |

* cited by examiner

CALIBRATION OF HAZARD DETECTION SENSITIVITY BASED ON OCCUPANCY IN A CONTROL ZONE

This application claims the benefit of an earlier filing date from Indian Provisional Application No. 201811018414 filed May 17, 2018, the entire disclosure of which is incorporated herein by reference.

BACKGROUND

The disclosed embodiments relate to controlling a hazard detection system and more specifically to the calibration of hazard detection sensitivity based on occupancy in a control zone.

At the time of installing a hazard detection system, such as a fire alarm system, the sensitivity of the system may be based on time and location. Once the system is installed the sensitivity of the fire alarm may be set in two different modes, a day mode and a night mode, and these modes may be associated with a preset sensor sensitivity. The night mode sensitivity of the system may be high compared to day mode settings, as there may be a limited scope of human activities at night compared with during the day. Human activities may lead to dust accumulation in the detectors, and may result in an increase in room temperature.

There may be times and situations which demand a combination of a relatively low sensitivity and a relatively high sensitivity in a given room for a particular day. For example, a conference room may be busy with occupants in one hour and may be empty a next hour. In case of a fire incident, time taken by the system to detect the fire may be based on the sensitivity mode or settings of the system rather than room occupancy.

BRIEF DESCRIPTION

Disclosed is an alarm device for detecting a hazard in a control zone, the alarm device comprising: a hazard sensor that comprises a configurable sensitivity level and a device controller that controls the sensitivity level of the hazard sensor, wherein the alarm device: receives over an electronic network a target sensitivity, and calibrates the hazard sensor to achieve the target sensitivity level.

In addition to one or more of the above disclosed features or as an alternate the hazard sensor is a first hazard sensor of a plurality of hazard sensors within the alarm device, each of the plurality of hazard sensors comprising a configurable sensitivity level, wherein the alarm device calibrates each of the plurality of hazard sensors to achieve the target sensitivity level.

In addition to one or more of the above disclosed features or as an alternate the plurality of hazard sensors includes at least one of a heat sensor, a smoke sensor, a carbon monoxide sensor and a gas sensor.

Disclosed is a system for detecting hazards in a control zone, the system including an alarm device having one or more of the above disclosed features, the system including a system controller, wherein the system controller determines the target sensitivity level for the control zone and communicates the target sensitivity level to the alarm device over the network.

In addition to one or more of the above disclosed features or as an alternate the system controller determines the target sensitivity level based on occupancy in the control zone.

In addition to one or more of the above disclosed features or as an alternate the occupancy in the control zone is determined from one or more occupancy sensors in the control zone.

In addition to one or more of the above disclosed features or as an alternate the one or more occupancy sensors include one or more of a motion sensing camera, a passive infrared sensor and a thermal imaging camera.

In addition to one or more of the above disclosed features or as an alternate the occupancy in the control zone is determined based on electronic occupancy records.

In addition to one or more of the above disclosed features or as an alternate the electronic occupancy records include one or more of an access management system and a synchronized scheduling calendar.

In addition to one or more of the above disclosed features or as an alternate the alarm device is a first alarm device of a plurality of alarm devices, the plurality of alarm devices being disposed in a plurality of zones, wherein each of the plurality of alarm devices is set to a different target sensitivity.

Further disclosed is a method for detecting a hazard in a control zone with an alarm device, the alarm device comprising one or more of the above disclosed features.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
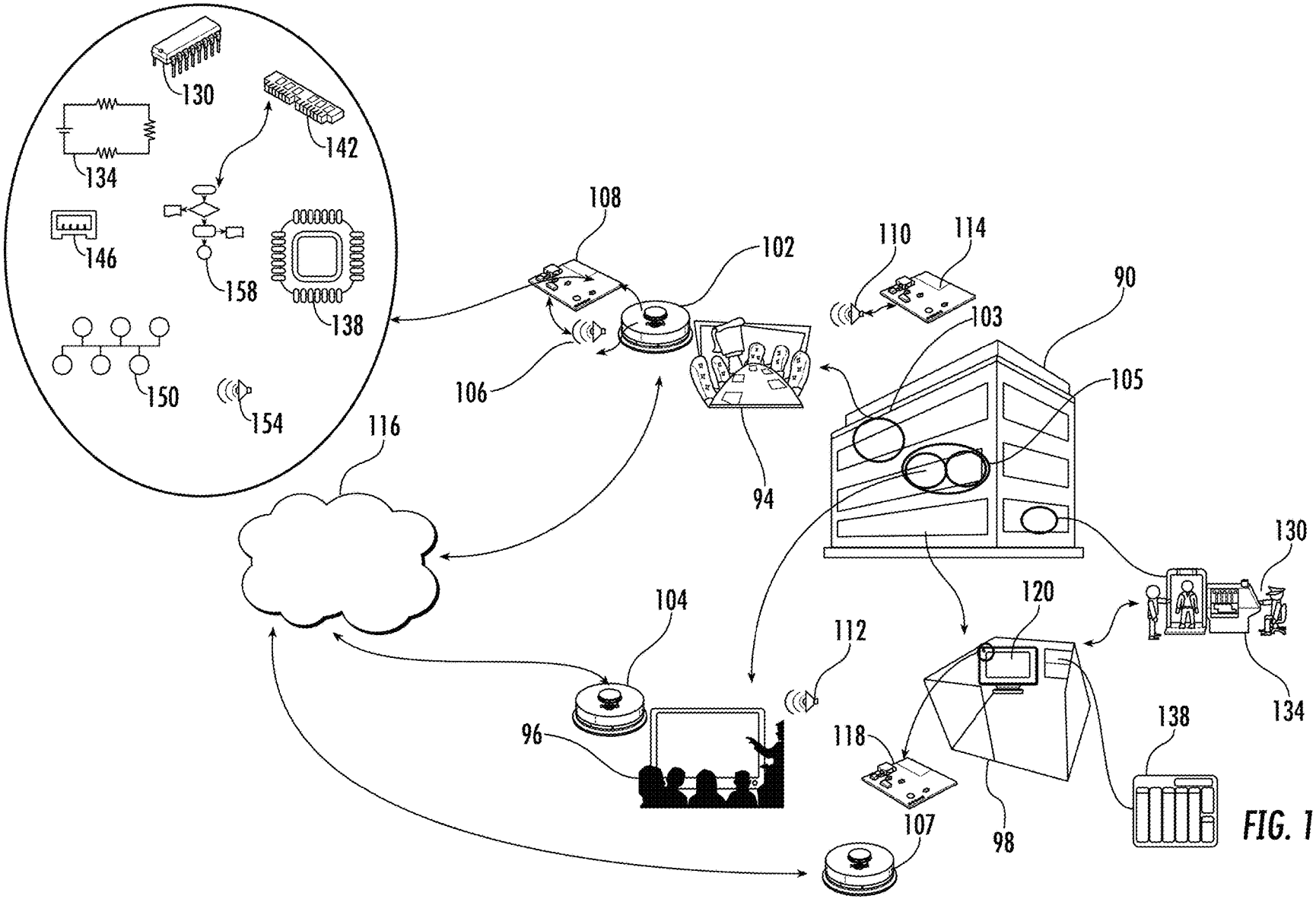
FIG. 1 illustrates an environment for utilizing a system for controlling a sensitivity of alarm devices according to a disclosed embodiment.

An environment for the disclosed innovation is illustrated in FIG. 1. A commercial building 90 such as an office complex may have a plurality of segmented office spaces, including a first office space 94, a second office space 96, and a third office space 98. The illustrated plurality of office spaces may be a first conference room 94, a second conference room 96 and an administrative office 98. In the illustration, the first office space 94 may be unoccupied while the second office space 96 may have an active conference and the third office space 98 may be unoccupied.

Within the office building 90 there may be a networked plurality of alarm devices, including a first alarm device 102, a second alarm device 104 and a third alarm device 107. The plurality of alarm devices may include a plurality of smoke detectors, alternatively referred to as fire/smoke detectors. The plurality of devices may include heat alarm devices and multi/combined smoke and heat alarm devices or Fire Sensing devices. Although not discussed in detail below, the plurality of devices may alternatively have additional sensing capabilities for other hazards such as gas or carbon monoxide (CO). The first alarm device 102 may be in the first office space 94, the second alarm device 104 may be in the second office space 96 and the third alarm 107 may be in the third office space 98.

The alarm devices may be associated with a plurality of alarm control zones within the office building 90. Accordingly, the first alarm device 102 may be associated with a first control zone 103 of the plurality of control zones, and the second alarm device 104 and third alarm device 107 may be associated with a second control zone 105 of the plurality of control zones. The plurality of alarm devices including 102, 104 and 107 may be substantially similar so that the alarm devices may be collectively discussed with reference to the first alarm device 102 which hereinafter may be alternatively referred to as alarm device 102.

The alarm device 102 may include a hazard sensor 106 which may be a smoke sensor or thermal sensor which may be set to a first sensitivity level. The alarm device 102 may further include an alarm controller 108, which may be a first electronic controller for controlling the functionality and capabilities of the alarm device 102. Features of the alarm controller 108 are provided below.

The alarm controller 108 may calibrate the alarm device 102 to control the sensitivity of the hazard sensor 106. As the sensitively level of the hazard sensor 106 is increased, the alarm device 102 may be more readily set off. A more sensitive alarm may be undesirable during a high occupancy period where human activity may raise temperatures in a room though no hazard is present. On the other hand, a more sensitive hazard sensor 106 may be desirable during low or no-occupancy periods.

The sensitivity of the alarm components may be based on, for example, a look up table (or other suitable data structure) within the alarm controller 108 and/or based on received sensitivity information for example stored in the system controller 118. The look up table may include information that identifies different sensitivity levels for different sensors and detection components. For example a smoke detector may have a different sensitivity level than an optical sensor. The obtained sensitivity information may be factored into an analysis within the alarm controller 108.

A plurality of networked occupancy sensors may be provided, including a first occupancy sensor 110 in the first office space and a second occupancy sensor 112 in the second office space. The occupancy sensors may be substantially similar so that the occupancy sensors may be collectively discussed with reference to the first occupancy sensor 110 which hereinafter may be alternatively referred to as occupancy sensor 110. The occupancy sensor 110 may include a sensor controller 114, which may be a second electronic controller for controlling the functionality and network capabilities of the occupancy sensor 110. The occupancy sensor 110 may be, for example, one or more of a motion sensing camera, a thermal imaging camera and a passive infrared (PIR) sensor.

In some embodiments, the occupancy sensor 110 is integral with the alarm device 102. In such embodiments, the operations of the occupancy sensor 110 as discussed hereinafter would be integral with the alarm device 102.

In embodiments where the occupancy sensor 110 is separate from the alarm device 102, the alarm device 102 and the occupancy sensor 110 may communicate over a network 116, which may be an electronic communications network, with a system controller 118, which may be a third electronic controller. Features of the system controller 118 are provided below. The system controller 118 may be disposed within an interactive control panel 120 in the administrative office 98. The system controller 118 may be capable of two way communications with the alarm device 102 and the occupancy sensor 110 over the network 116.

The network 116 may apply wireless telecommunication protocols such as protocols applicable for electronic short range communications (SRC). For example the network 116 may be a private area network (PAN), which includes Bluetooth Low Energy (BTLE). BTLE is a wireless technology standard designed and marketed by the Bluetooth Special Interest Group (SIG) for exchanging network access codes (credentials) over short distances using short-wavelength radio waves. PAN technologies also include Zigbee, a technology based on Section 802.15.4 from the Institute of Electrical and Electronics Engineers (IEEE). More specifically, Zigbee represents a suite of high-level communication protocols used to create personal area networks with small, low-power digital radios for low-power low-bandwidth needs, and is suited for small scale projects using wireless connections. Alternatively, the network 116 may apply local area network (LAN) protocols such as WiFi, which is a technology based on the Section 802.11 from the IEEE. Of course, these are non-limiting examples of wireless telecommunication protocols. In addition, wired networks are within the scope of the disclosure.

As illustrated in FIG. 1 and disclosed above, the embodiments herein may include a plurality controllers including the alarm controller 108 and the system controller 118. These controllers may have substantially the same types of technology features so that the controllers may be collectively discussed with reference to the alarm controller 108.

The alarm controller 108 may be a computing device that includes processing circuitry that may further include an application specific integrated circuit (ASIC) 130, an electronic circuit 134, an electronic processor (shared, dedicated, or group) 138 and memory 142 that executes one or more software or firmware programs, a combinational logic circuit, and/or other suitable interfaces and components that provide the described functionality. For example, the processor 138 processes data stored in the memory 142 and employs the data in various control algorithms, diagnostics and the like.

In addition to a processor 138 and memory 142, the alarm controller 108 may include one or more input and/or output (I/O) device interface(s) 146 that are communicatively coupled via a local interface to communicate among the plurality of controllers. The local interface may include, for example but not limited to, one or more buses 150 and/or other wired or wireless connections 154. The local interface may have additional elements, which are omitted for simplicity, such as controllers, buffers (caches), drivers, repeaters, and receivers to enable communications. Further, the local interface may include address, control, and/or data connections to enable appropriate communications among the aforementioned components.

In operation, the processor 138 may be configured to execute software 158 stored within the memory 142, to communicate data to and from the memory 142, and to generally control operations of the alarm controller 108 pursuant to the software 158. Software 158 in memory 142, in whole or in part, may be read by the processor 138, perhaps buffered within the processor 138, and then executed. The processor 138 may be hardware devices for executing software 158, particularly software 158 stored in memory 142. The processor 138 may be a custom made or a commercially available processor 158, a central processing units (CPU), an auxiliary processor among several processors associated with computing devices, semiconductor based microprocessors (in the form of microchips or chip sets), or generally any such devices for executing software.

The memory 142 may include any one or combination of volatile memory elements (e.g., random access memory (RAM, such as DRAM, SRAM, SDRAM, VRAM, etc.)) and/or nonvolatile memory elements (e.g., ROM, hard drive, tape, CD-ROM, etc.). Moreover, the memory 142 may incorporate electronic, magnetic, optical, and/or other types of storage media. Note that the memory 142 can also have a distributed architecture, where various components are situated remotely from one another, but can be accessed by the processor 138.

The software 158 in the memory 142 may include one or more separate programs, each of which includes an ordered listing of executable instructions for implementing logical functions. A system component embodied as software may also be construed as a source program, executable program (object code), script, or any other entity comprising a set of instructions to be performed. When constructed as a source program, the program 158 is translated via a compiler, assembler, interpreter, or the like, which may or may not be included within the memory.

The Input/Output devices that may be coupled to system I/O Interface(s) 146 may include input devices the illustration of which being omitted for brevity, such as a keyboard, mouse, scanner, microphone, camera, proximity device, etc. Further, the Input/Output devices may also include output devices the illustration of which being omitted for brevity, for example but not limited to, a printer, display, etc. Finally, the Input/Output devices may further include devices that communicate both as inputs and outputs the illustration of which being omitted for brevity, for instance, but not limited to, a modulator/demodulator (modem; for accessing another device, system, or network), a radio frequency (RF) or other transceiver, a telephonic interface, a bridge, a router, etc.

One should note that the above disclosed architecture, functionality, and/or hardware operations may be implemented by software. In software, such functionality may be represented as a module, segment, or portion of code, which comprises one or more executable instructions for implementing the specified logical function(s). It should also be noted that such modules may not necessarily be executed in any particular order and/or executed at all.

One should note that any of the functionality described herein can be embodied in any computer-readable medium for use by or in connection with an instruction execution system, apparatus, or device, such as a computer-based system, processor-containing system, or other system that can fetch the instructions from the instruction execution system, apparatus, or device and execute the instructions. In the context of this document, a "computer-readable medium" contains, stores, communicates, propagates and/or transports the program for use by or in connection with the instruction execution system, apparatus, or device.

The computer readable medium can be, for example but not limited to, an electronic, magnetic, optical, electromagnetic, infrared, or semiconductor system, apparatus, device or form of computer readable memory 142. More specific examples (a non-exhaustive list) of a computer-readable medium the illustration of which being omitted for brevity include a portable computer diskette (magnetic), a random access memory (RAM) (electronic), a read-only memory (ROM) (electronic), an erasable programmable read-only memory (EPROM or Flash memory) (electronic), and a portable compact disc read-only memory (CDROM) (optical).

Figure 2:
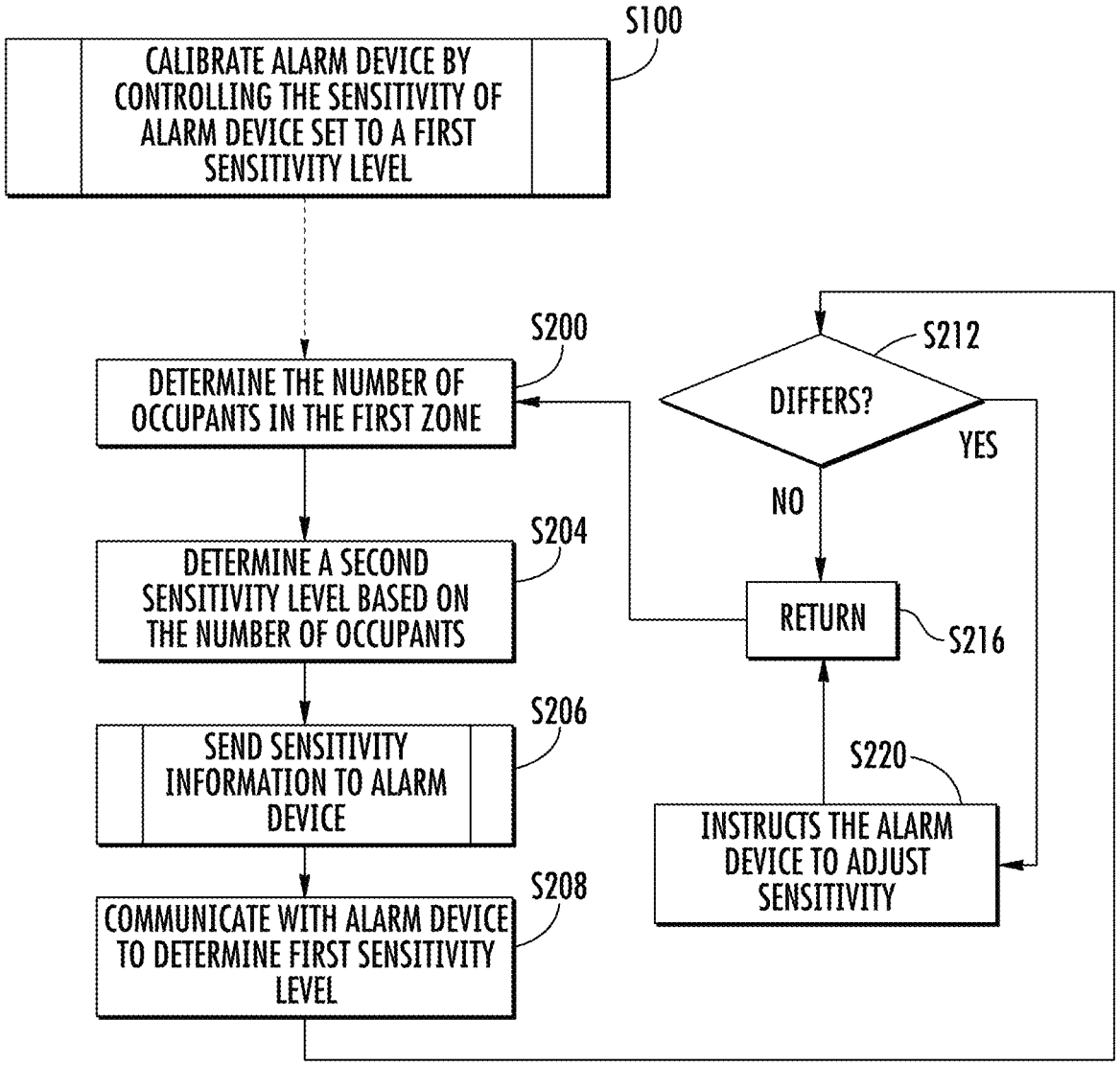
FIG. 2 illustrates a process for controlling a sensitivity of alarm devices according to a disclosed embodiment.
Figure 3:
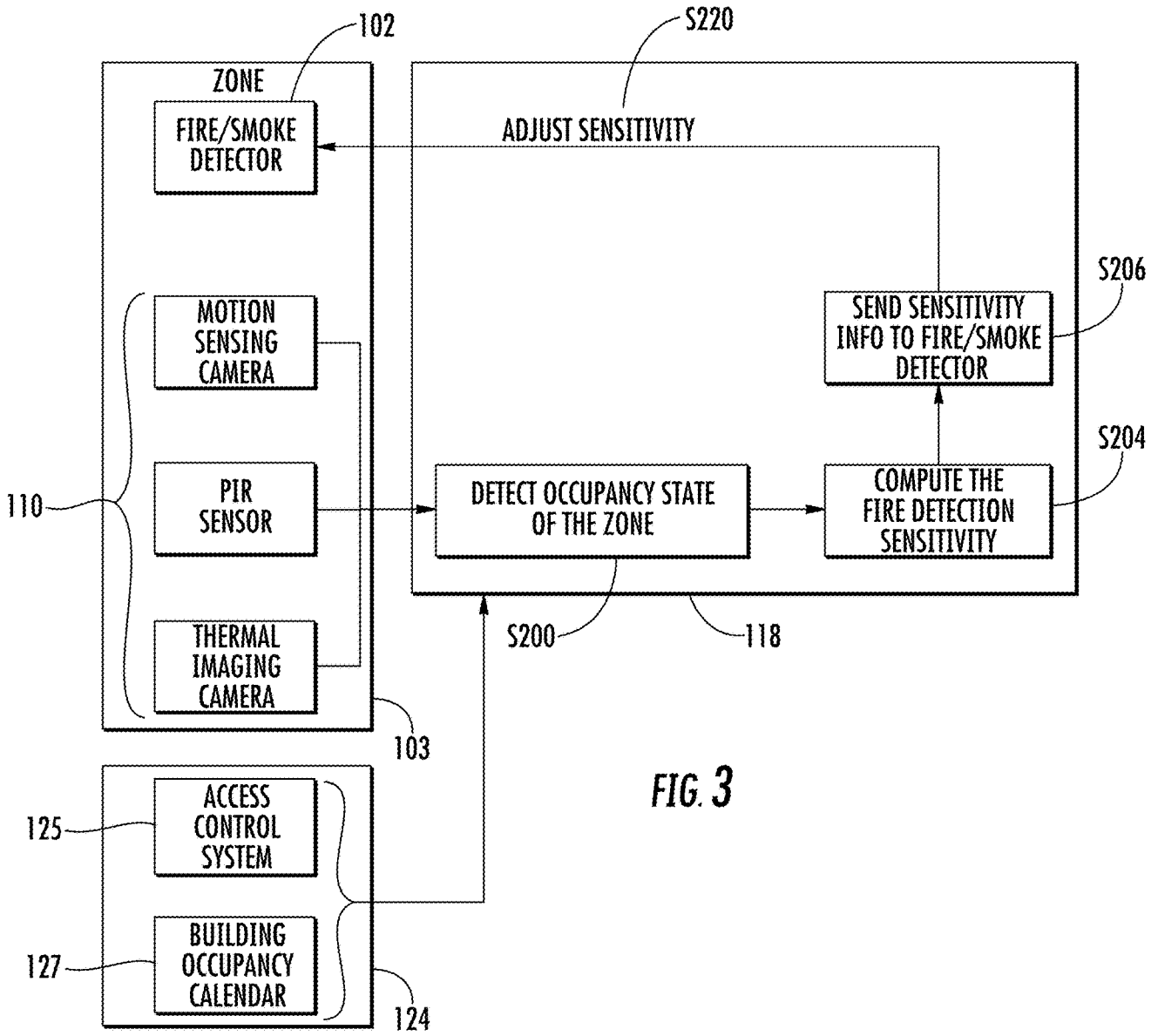
FIG. 3 is a composite process and component illustration for a system for controlling sensitivity of alarm devices according to a disclosed embodiment.

FIGS. 2 and 3 illustrate a process or series of steps collectively referenced as S100 for calibrating the alarm device 102 by controlling the sensitivity of the alarm device 102, which is set to the first sensitivity level. The process may include a first step S200 of the system controller 118 determining the number of occupants and/or the occupancy state in the first control zone 103. This may occur by the system controller 118 communicating with the occupancy sensor 110 every few seconds, every few minutes or the like.

Alternatively or in addition, the system controller 118 may review electronic occupancy records 124 including electronically scheduled bookings for the first office space 94 to determine a number of occupants and/or an occupancy state in the first control zone 103. Such electronic occupancy records 124 may be stored in a building access management system 125 which may be updated at a security booth 134 for the office building 90, at the administrative office 98, and/or in a distributed system such as a synchronized electronic building scheduling calendar 127 which may be updated through any number of electronic access points. For example, a building occupancy calendar 127 may list a certain number of identified people scheduled to be in the first office space 94 at a certain time for a conference. The building access management system 125 may be updated dynamically to provide an additional number of people, such as building guests, who will be in the first office space 94 at the same time for the conference. The system controller 118 may synchronize with the access management system and/or the building calendar upon each use of the access management system and/or the building calendar so as to calculate a number of people in the first office space 94 for the conference. The controller 118 may use this information along with or in addition to the data obtained from the occupancy sensors 110 to compute the fire detection sensitivity.

At step S204 the system controller 118 may determine, for example by selecting and/or computing, a second sensitivity level, which is may be a target sensitivity level, which may be a smoke sensitively level for the hazard sensor 106 in the alarm device 102. The determination at S204 may be based on the number of occupants and/or the occupancy state detected in the first control zone 103.

At step S206 the system controller 118 may send the sensitivity level information to the alarm device. With step S206, at step S208 the system controller 118 may communicate with the alarm device 102 to determine the first sensitivity level for the hazard sensor 106 in the alarm device 102. In addition, at step S212 the system controller 118 may determine whether the first sensitivity level differs from the second sensitivity level. If the determination at S212 is "no" then the system controller 118 at step S216 may return to step S200, disclosed above. If the determination at S212 is "yes" then at step S220 the system controller 118 may instruct the alarm device 102 to adjust the first sensitivity level of the hazard sensor 106 to the second sensitivity level. Then the system controller 118 may advance to step S216, disclosed above. This process may be performed for each of the plurality of alarm devices in each zone of the plurality of zones 103, 105 to confirm that the protection in each zone is appropriate for the number of occupants in the zone.

In accordance with the disclosed embodiments, if a room is empty, a fire may be detected more quickly than it would be detected if alarm devices have sensitivity levels that are adjusted based on a time of day. The above disclosed embodiments may provide a dynamically self-calibrating fire alarm system based on occupancy rather than time. This occupancy data may be a significant variable used to calibrate sensitivity levels within the fire alarm system. To detect the occupancy, the following sensor technologies may be utilized: PIR sensors; motion detection cameras; thermal image cameras; building access management systems; and/or building calendars. For example a conference room availability in an office may be known from a synchronized office electronic calendar.

As compared with related technologies, the disclosed embodiments may enable a fire alarm system to detect fire earlier, which may provide additional time for people to evacuate a premises and may save more lives. With such comparison, the disclosed embodiments may provide a smarter fire alarm system by providing an enhanced technology environment.

The term "about" is intended to include the degree of error associated with measurement of the particular quantity based upon the equipment available at the time of filing the application.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

While the present disclosure has been described with reference to an exemplary embodiment or embodiments, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the claims.

What is claimed is:

1. A system for detecting hazards in a control zone, the system including:

an alarm device for detecting a hazard in a control zone, the alarm device comprising:

a hazard sensor that comprises a configurable sensitivity level and a device controller that controls the sensitivity level of the hazard sensor, wherein the alarm device receives over an electronic network a target sensitivity, and calibrates the hazard sensor to achieve the target sensitivity level;

wherein the hazard sensor is a first hazard sensor of a plurality of hazard sensors within the alarm device, each of the plurality of hazard sensors comprising a configurable sensitivity level, wherein the alarm device calibrates each of the plurality of hazard sensors to achieve the target sensitivity level; and wherein the plurality of hazard sensors includes at least one of a heat sensor, a smoke sensor, a carbon monoxide sensor and a gas sensor;

the system including a system controller, wherein the system controller determines the target sensitivity level for the control zone and communicates the target sensitivity level to the alarm device over the network;

the system controller determines the target sensitivity level based on occupancy in the control zone, and the occupancy in the control zone is determined from one or more occupancy sensors in the control zone.

2. The system of claim 1, wherein the one or more occupancy sensors include one or more of a motion sensing camera, a passive infrared sensor and a thermal imaging camera.

3. The system of claim 1, wherein the occupancy in the control zone is determined based on electronic occupancy records.

4. The system of claim 3 wherein the electronic occupancy records include one or more of an access management system and a synchronized scheduling calendar.

5. The system of claim 4 wherein the alarm device is a first alarm device of a plurality of alarm devices, the plurality of alarm devices being disposed in a plurality of zones, wherein each of the plurality of alarm devices is set to a different target sensitivity.

6. A method for detecting hazards in a control zone with a hazard detection system, wherein the system includes a system controller and an alarm device in the control zone, the alarm device comprising a hazard sensor that comprises a configurable sensitivity level and a device controller that controls the sensitivity level of the hazard sensor, wherein the method comprises the alarm device receiving over an electronic network a target sensitivity; and calibrating the hazard sensor to achieve the target sensitivity level;

wherein the hazard sensor is a first hazard sensor of a plurality of hazard sensors within the alarm device, each of the plurality of hazard sensors comprising a configurable sensitivity level, wherein the alarm device calibrates each of the plurality of hazard sensors to achieve the target sensitivity level, the plurality of hazard sensors includes at least one of a heat sensor, a smoke sensor, a carbon monoxide sensor and a gas sensor;

wherein the method further comprises the system controller determining the target sensitivity level for the control zone and communicates the target sensitivity level to the alarm device over the network, wherein the system controller determines the target sensitivity level based on occupancy in the control zone; and wherein the occupancy in the control zone is determined from one or more occupancy sensors in the control zone.

7. The method of claim 6, wherein the one or more occupancy sensors include one or more of a motion sensing camera, a passive infrared sensor and a thermal imaging camera.

8. The method of claim 6, wherein the occupancy in the control zone is determined based on electronic occupancy records.

9. The method of claim 8 wherein the electronic occupancy records include one or more of an access management system and a synchronized scheduling calendar.

10. The method of claim 9 wherein the alarm device is a first alarm device of a plurality of alarm devices, the plurality of alarm devices being disposed in a plurality of zones, wherein each of the plurality of alarm devices is set to a different target sensitivity.

* * * * *